US007470843B2

(12) United States Patent
Hsieh

(10) Patent No.: US 7,470,843 B2
(45) Date of Patent: Dec. 30, 2008

(54) FOLDABLE GUITAR HOLDER

(75) Inventor: Wu-Hong Hsieh, Lu Chou (TW)

(73) Assignee: K. H. S. Musical Instrument Co., Ltd., Taipei Hsien (TW)

( * ) Notice: Subject to any disclaimer, the term of this patent is extended or adjusted under 35 U.S.C. 154(b) by 0 days.

(21) Appl. No.: 11/639,197

(22) Filed: Dec. 15, 2006

(65) Prior Publication Data

US 2008/0141844 A1 Jun. 19, 2008

(51) Int. Cl.
*G10D 3/00* (2006.01)

(52) U.S. Cl. ..... 84/329; 84/327; 84/453

(58) Field of Classification Search ..... 84/327, 84/329, 453

See application file for complete search history.

(56) References Cited

U.S. PATENT DOCUMENTS

| | | | | | |
|---|---|---|---|---|---|
| 1,670,397 | A * | 5/1928 | Yingling | 248/439 |
| 2,517,896 | A * | 8/1950 | Lawrence | 248/460 |
| 2,547,924 | A * | 4/1951 | Citro | 84/327 |
| 4,037,815 | A * | 7/1977 | DeLano | 248/542 |
| 4,691,610 | A * | 9/1987 | Gilbert | 84/327 |
| 4,693,161 | A * | 9/1987 | Uhrig | 84/327 |
| 5,197,701 | A * | 3/1993 | Olson | 248/166 |
| 5,505,413 | A * | 4/1996 | Hennessey | 248/166 |
| 5,664,756 | A * | 9/1997 | Liao | 248/443 |
| 5,957,417 | A * | 9/1999 | Yu | 248/166 |
| 6,005,176 | A * | 12/1999 | Yu | 84/327 |
| 6,145,801 | A * | 11/2000 | Herring, Jr. | 248/463 |
| 6,323,406 | B1 * | 11/2001 | Park | 84/327 |
| 6,412,742 | B1 * | 7/2002 | Yu | 248/434 |
| 6,484,977 | B1 * | 11/2002 | Yu | 248/125.1 |
| 2004/0056166 | A1 * | 3/2004 | Harrison | 248/434 |

* cited by examiner

*Primary Examiner*—Jeffrey Donels
*Assistant Examiner*—Christopher Uhlir
(74) *Attorney, Agent, or Firm*—Bacon & Thomas, PLLC

(57) ABSTRACT

A foldable guitar holder has a stationary shaft, a central shaft assembly and two symmetrical brackets. The stationary shaft has an upper end and a lower end. The central shaft has a central shaft and two assistant shafts. The central shaft has a standing portion and a longitudinal hole receiving the lower end of the stationary shaft. The assistant shafts connect pivotally to the central shaft and have two standing ends. The brackets have two supporting shafts and two holding brackets. Each supporting shaft connects pivotally to the lower end of the stationary shaft and one of the assistant shafts and has a standing part. Each holding bracket connects pivotally to the upper end of the stationary bracket. The standing portion, standing ends and standing parts allow the guitar bracket to stand on the ground steadily.

9 Claims, 5 Drawing Sheets

FOLDABLE GUITAR HOLDER

BACKGROUND OF THE INVENTION

1. Field of Invention

The present invention relates to a foldable guitar holder, and more particularly to a foldable guitar holder that holds the guitar steadily.

2. Description of the Related Art

Lovers of guitars are unwilling to put the guitars on a ground and against a wall because they are afraid that the guitars will wear or slant and fall on the ground. Thus, the guitar is usually held by a guitar holder to prevent the guitar from contacting the ground. Moreover, the guitar on the guitar holder can be shown as a work of art.

With reference to FIG. 5, a conventional guitar holder (30) is foldable and has a bracket (31), two symmetrical pivoting shafts (32) and two symmetrical and parallel supporting shafts (33). The bracket (31) has at least one cushion surface (36) to allow a guitar to lean on. The pivoting shafts (32) pivotally connect to the bracket (31) and each pivoting shaft (32) has a surface. The surface corresponds to the cushion surface (36) of the bracket (31) and has a holding bracket (35). The holding bracket (35) is L-shaped to hold a guitar and has two ends. One of the ends is mounted on the pivoting shaft (32). The supporting shafts (33) lie on the ground and each supporting shaft (33) connects with one pivoting shaft (32) and has two ends. Each end of the supporting shaft (33) has a cushion (34). The cushion (34) envelops the end of the supporting shaft (33) to increase an area providing friction, so the supporting shaft (33) can stand on the ground steadily.

However, the supporting shaft (33) only has four ends with cushions (34) standing on the ground, so the stability of the conventional guitar bracket is not enough. Furthermore, each holding bracket (35) only has one end to connect with the pivoting shaft (32), so the holding bracket (35) may break to cause the guitar to fall on the ground.

To overcome the shortcomings, the present invention provides a foldable guitar holder to mitigate or obviate the aforementioned.

SUMMARY OF THE INVENTION

The primary objective of the present invention is to provide a foldable guitar holder that holds the guitar steadily.

To achieve the objective, the foldable guitar holder in accordance with the present invention has a stationary shaft, a central shaft assembly and two symmetrical brackets. The stationary shaft has an upper end and a lower end. The central shaft has a central shaft and two assistant shafts. The central shaft has a standing portion and a longitudinal hole. The longitudinal hole receives the lower end of the stationary shaft. The assistant shafts connect pivotally to the central shaft and have two standing ends. The brackets have two supporting shafts and two holding brackets. Each supporting shaft connects pivotally to the lower end of the stationary shaft and one of the assistant shafts and has a standing part. Each holding bracket connects pivotally to the upper end of the stationary bracket and has two bending parts and a holding part. The bending parts are supported respectively by supporting shafts. The holding part is formed between two bending parts to hold a guitar. The standing portion, standing ends and standing parts allow the guitar bracket to stand on the ground steadily.

Other objectives, advantages and novel features of the invention will become more apparent from the following detailed description when taken in conjunction with the accompanying drawings.

DETAILED DESCRIPTION OF THE INVENTION

Figure 1:
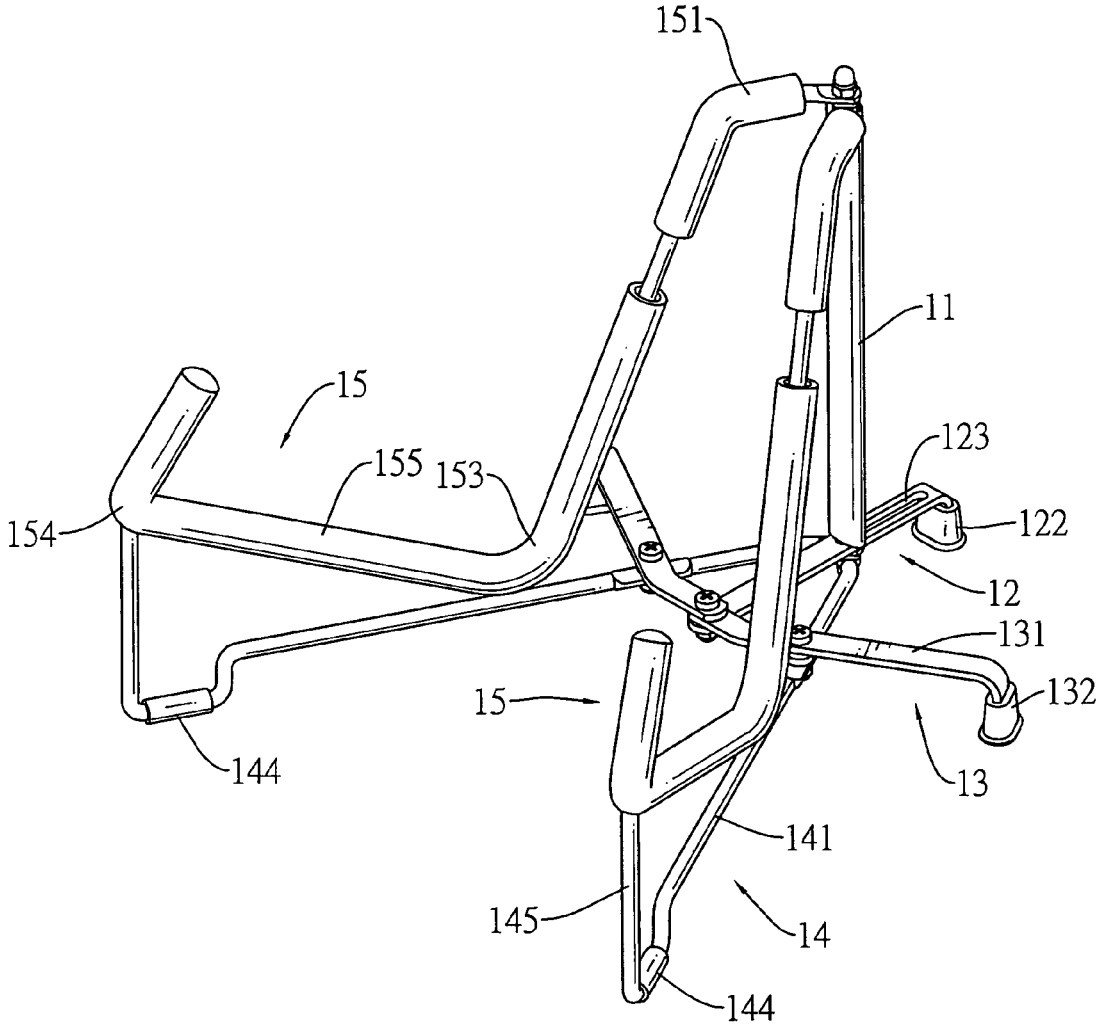
FIG. 1 is a perspective view of a foldable guitar holder in accordance with the present invention when the foldable guitar holder is unfolded.
Figure 2:
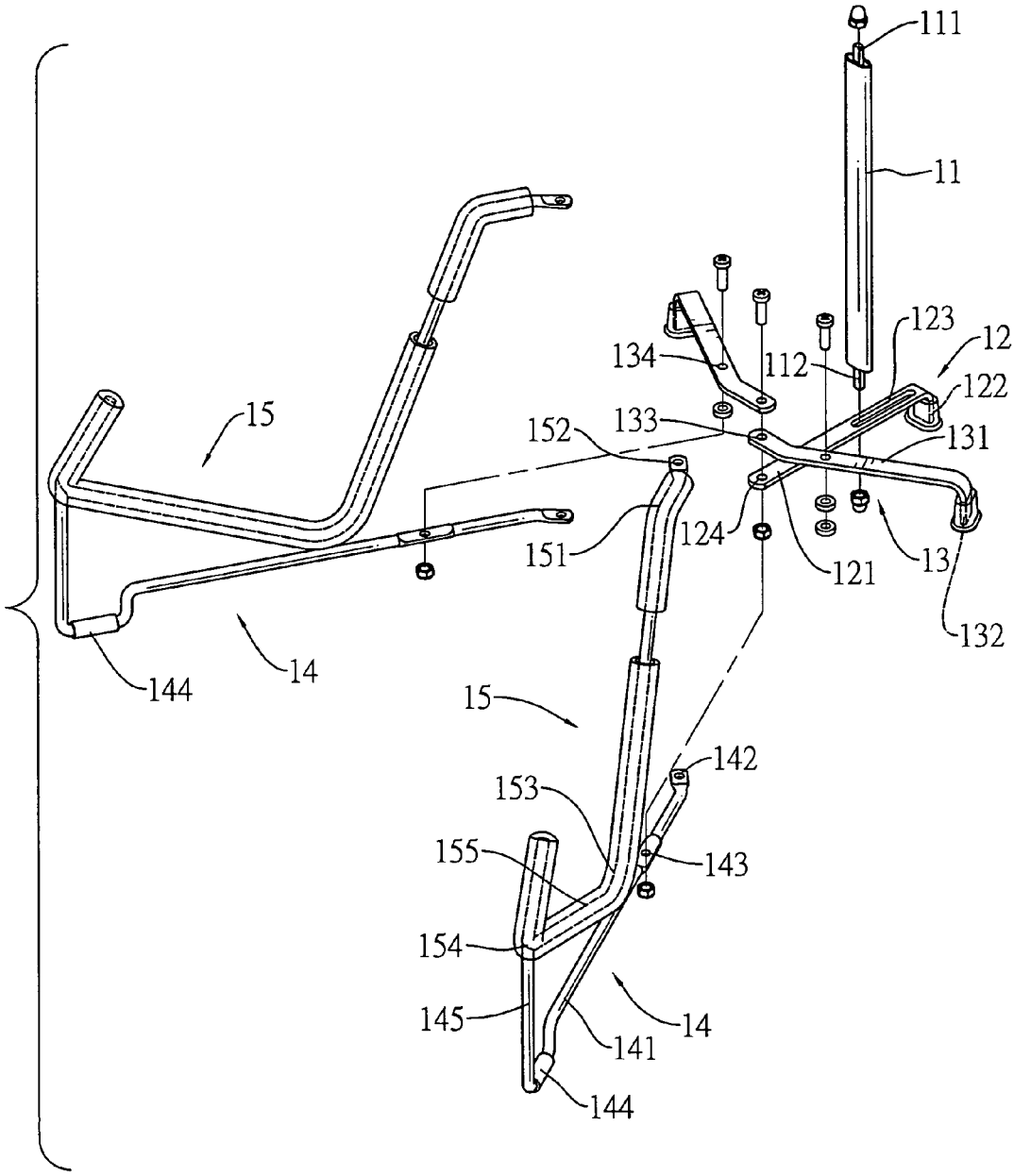
FIG. 2 is an exploded perspective view of the foldable guitar holder in FIG. 1.
Figure 3:
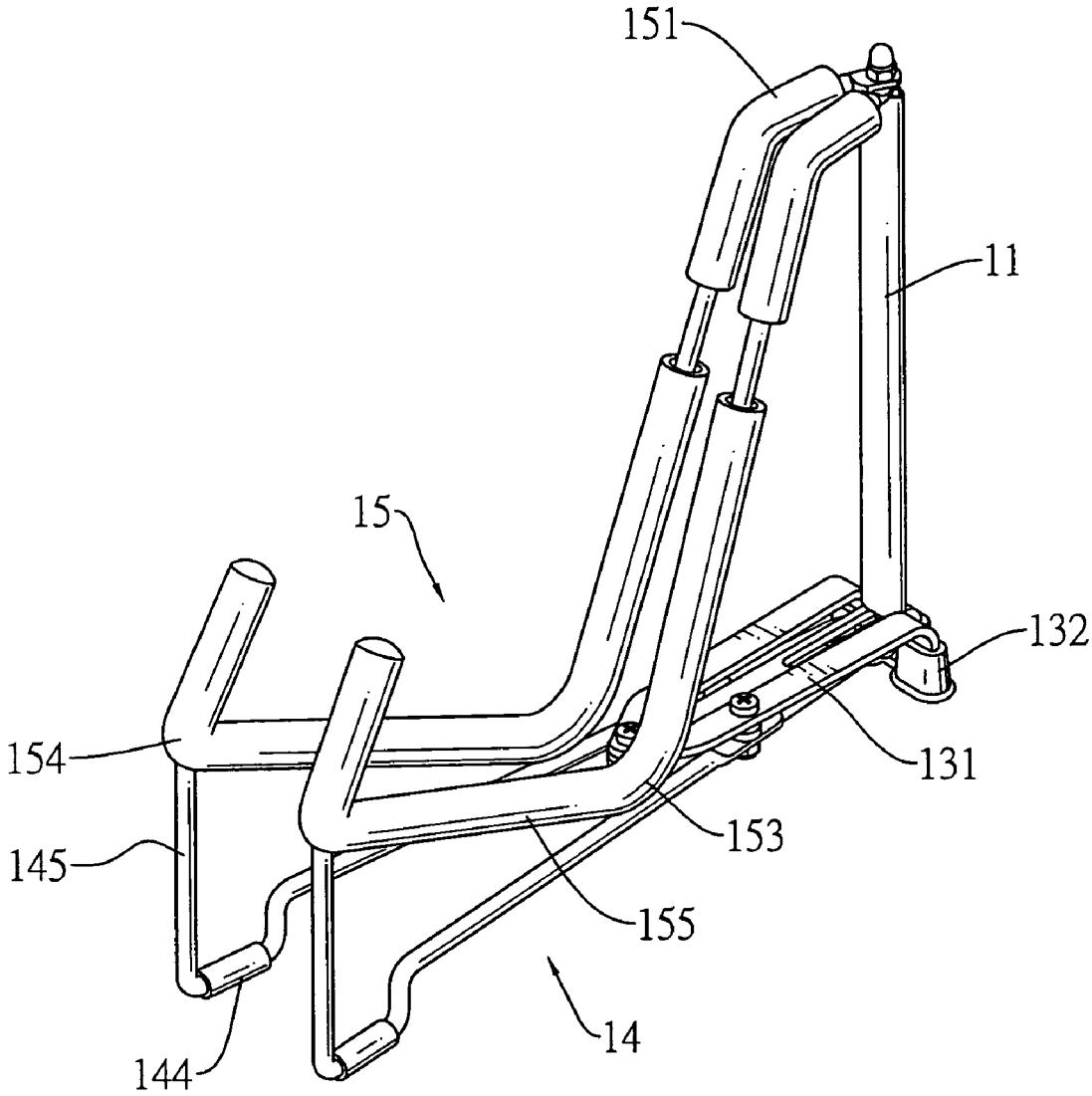
FIG. 3 is a perspective view of the foldable guitar holder in FIG. 1 when the guitar holder is folded.

With reference to FIGS. 1 to 3, a foldable guitar holder in accordance with the present invention has a stationary shaft (11), a central shaft assembly and two brackets.

The stationary shaft (11) has an upper end (111) and a lower end (112). Each end (111, 112) may have a screw.

The central shaft assembly is mounted perpendicularly on the lower end (112) of the stationary shaft (11) and has a central shaft (12) and two assistant shafts (13).

The central shaft (12) is L-shaped, is mounted slidably on the lower end (112) of the stationary shaft (11) and has a body (121) and a standing portion. The body (121) has a distal end, a proximal end and a longitudinal hole (123). The distal end has a fastening hole (124). The fastening hole (124) is defined through the distal end of the body (121). The longitudinal hole (123) is defined through the body (121) and allows the lower end (112) of the stationary shaft (11) to extend in and move slidably along the longitudinal hole (123). The standing portion is formed on the proximal end of the body (121), stands on a ground and may have a bending part (122) and a cushion. The bending part (122) is formed on and extending perpendicularly from the proximal end of the body (121). The cushion envelops the bending part (122) to provide friction, so the central shaft (12) can stand on the ground steadily.

The assistant shafts (13) are arranged symmetrically. Each assistant shaft (13) is L-shaped, is mounted pivotally on the distal end of the body (121) of the central shaft (12) and has a body (131) and a bending part (132). The body (131) has a distal end, a proximal end and a middle part. The distal end has a pivoting hole (133). The pivoting hole (133) is defined through the distal end of the body (131), corresponds to the fastening hole (124) and may allow a screw to be mounted through the fastening hole (124) and the pivoting holes (133) of the assistant shafts (13). A nut is screwed onto the screw so the assistant shaft (13) is mounted pivotally on the central shaft (12). The middle part is formed between the distal end and the proximal end and has a hole (134). The hole (134) is defined through the body (131) of the assistant shaft (13). The bending part (132) is formed on the proximal end of the body (131) and has a standing end. The standing end stands on the ground and may have a cushion. The cushion envelops the standing end of the bending part (132) to provide friction, so the assistant shaft (13) can stand on the ground steadily without inadvertently slipping. The standing ends will be moved close to the standing portion of the central shaft (12) by pivoting the body (131) when the guitar holder is folded. The standing ends will be moved away from the standing portion of the central shaft (12) by pivoting the body (131) when the guitar holder is unfolded.

The brackets correspond respectively to the assistant shafts (13), are arranged symmetrically and each bracket has a supporting shaft (14) and a holding bracket (15).

The supporting shaft (14) is substantially L-shaped and has a connecting part (141), a standing part (144) and a supporting part (145). The connecting part (141) has a proximal end, a distal end and a middle part. The proximal end connects pivotally to the lower end (112) of the stationary shaft (11) and has a limiting hole (142). The limiting hole (142) is defined through the proximal end and allows the lower end (112) of the stationary shaft (11) to extend in to connect pivotally to the supporting shaft (14) to prevent the lower end (112) from disengaging from the longitudinal hole (123). The limiting hole (142) and the lower end (112) of the stationary shaft (11) can be connected together by a nut mounted on the screw of the lower end (112). The middle part is formed between the proximal end and a distal end, connects pivotally to the middle part of the body (131) of the assistant shaft (13) and has a connecting hole (143). The connecting hole (143) is defined through the connecting part (141), corresponds to the hole (134) of a corresponding assistant shaft (13) and may allow a screw to be mounted in the connecting hole (143) and the hole (134). A nut is screwed onto the screw so that the supporting shaft (14) connects pivotally with the corresponding assistant shaft (13). The standing part (144) stands on the ground, is formed lower than the connecting part (141), is mounted on the distal end of the connecting part (141) and has an end and a cushion. The cushion envelops the standing part (144) to provide friction, so the supporting shaft (14) can stand on the ground steadily. The supporting part (145) is formed perpendicularly on the end of the standing part (144) and has an upper end.

Figure 4:
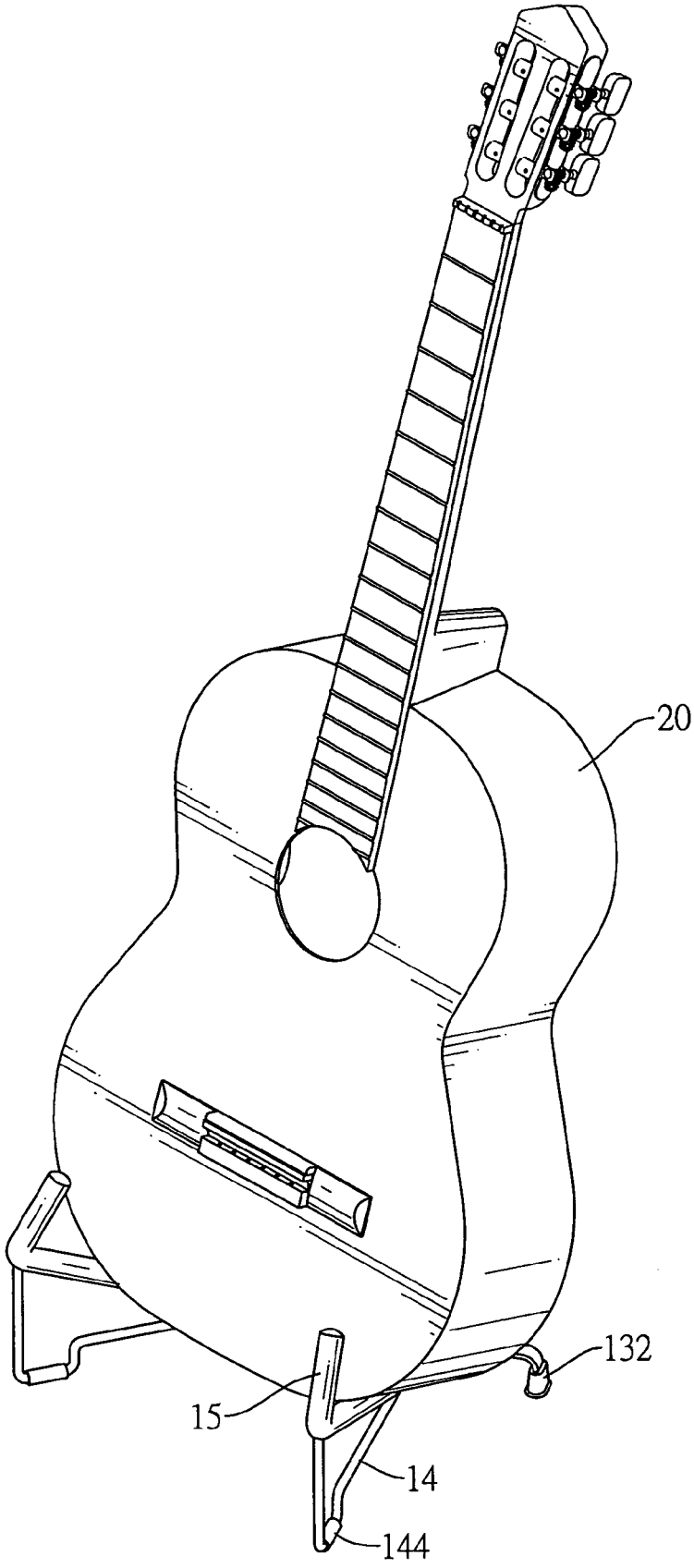
FIG. 4 is an operational perspective view of the foldable guitar holder in FIG. 1 holding a guitar.
Figure 5:
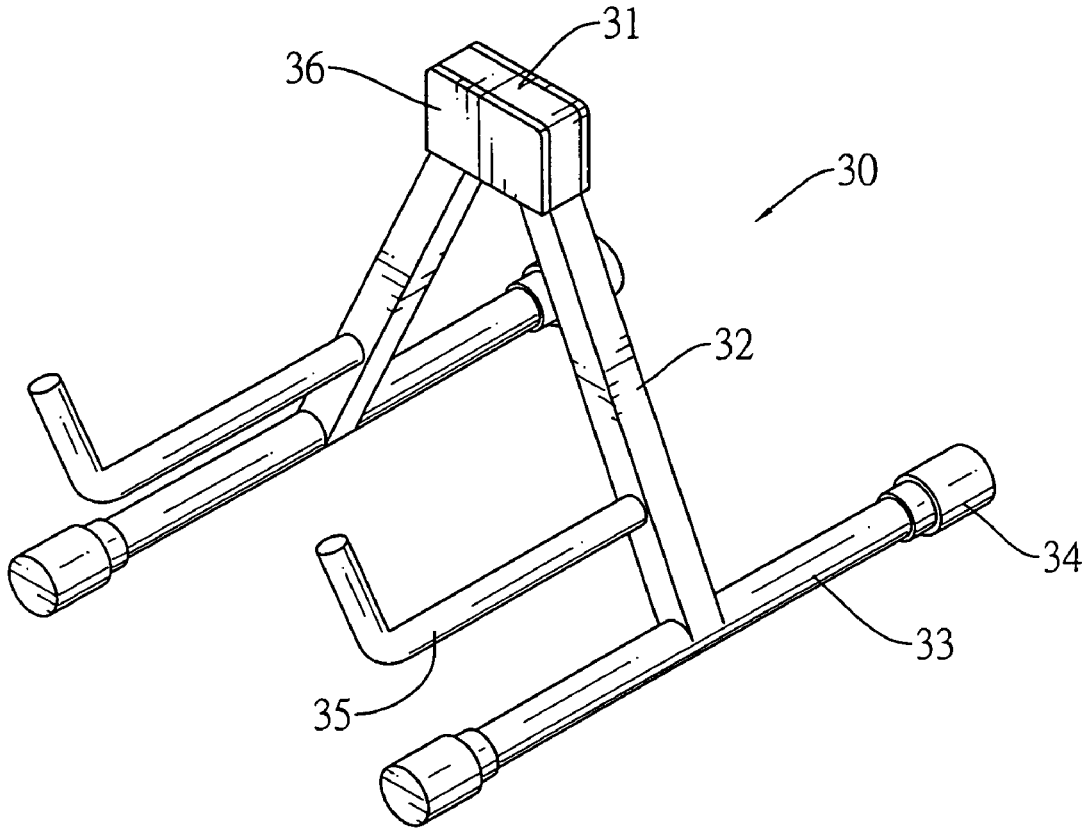
FIG.5 PRIOR ART
FIG. 5 is a perspective view of a conventional guitar holder in accordance with the prior art when the guitar holder is unfolded.

With further reference to FIG. 4, the holding brackets (15) are mounted on the supporting shafts (14) and may be enveloped by cushions and each holding bracket (15) is dipper-shaped and has a proximal end (151), a first bending part (153), a second bending part (154) and a holding part (155). The proximal end (151) connects pivotally to the upper end of the stationary shaft (111) and has a through hole (152). The through hole (152) is defined through the proximal end (151) and connects pivotally to the upper end (111) of the stationary shaft (11). The through hole (152) may allow the upper end (111) of the stationary shaft (11) to extend in and to be connected pivotally to the through hole (152) by a nut mounted on the upper end (111) when the upper end (111) has a screw. The first bending part (153) is supported by the connecting part (141) of the supporting shaft (14). The second bending part (154) is formed on and supported by the upper end of the supporting part (145) of the supporting shaft (14). The holding part (155) is formed between the first and second bending parts (153, 154) to hold a guitar (20).

Because the foldable guitar holder has multiple standing ends and two standing parts (144) to stand on the ground, the foldable guitar holder can stand steadily. Moreover, each holding bracket (15) is supported by the supporting shaft (14) on the first and the second bending part (153, 154), so the holding bracket (15) will not break to damage the guitar (20).

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A foldable guitar holder comprising:

a stationary shaft having
- an upper end; and
- a lower end;

a central shaft assembly mounted perpendicularly on the lower end of the stationary shaft and having
- a central shaft mounted slidably on the lower end of the stationary shaft and having
  - a body having
    - a distal end;
    - a proximal end; and
    - a longitudinal hole defined through the body and allowing the lower end of the stationary shaft to extend in and move slidably along the longitudinal hole; and
  - a standing portion formed on the proximal end of the body; and
- two assistant shafts arranged symmetrically, and each assistant shaft mounted pivotally on the distal end of the body of the central shaft and having
  - a body mounted pivotally on the distal end of the body of the central shaft and having
    - a distal end;
    - a proximal end; and
    - a middle part formed between the distal end and the proximal end; and
  - a bending part formed on the proximal end of the body and having a standing end;

two brackets corresponding respectively the assistant shafts, arranged symmetrically and having
- two supporting shafts and each supporting shaft having
  - a connecting part having
    - a proximal end mounted lower than the central shaft and connecting pivotally to the lower end of the stationary shaft;
    - a distal end; and
    - a middle part formed between the proximal end and a distal end and connecting pivotally to the middle part of the body of a corresponding one of the assistant shafts;
  - a standing part adapted to stand on a ground, formed lower than the connecting part, mounted on the distal end of the connecting part and having an end;
  - a supporting part formed perpendicularly on the end of the standing part and having an upper end; and
- two holding brackets mounted on the supporting shafts and each holding bracket having
  - a proximal end connecting pivotally to the upper end of the stationary shaft;
  - a first bending part supported by the connecting part of a corresponding one of the supporting shafts;
  - a second bending part formed on and supported by the upper end of the supporting part of the corresponding supporting shaft; and
  - a holding part formed between the first and second bending parts.

2. The foldable guitar holder as claimed in claim 1, wherein the distal end of the body of the central shaft has a fastening hole defined through the distal end of the body;

the distal end of the body of each assistant shaft has a pivoting hole defined through the distal end of the body and corresponding to the fastening hole in the central shaft;

the middle part of the body of each assistant shaft having a hole defined through the body of the assistant shaft;

the proximal end of the connecting part of each supporting shaft has a limiting hole defined through the proximal end and allowing the lower end of the stationary shaft to extend in to connect pivotally to the supporting shaft;

the middle part of the connecting part of each supporting shaft has a connecting hole defined through the connecting part and corresponding to the hole of a corresponding assistant shaft; and the proximal end of each holding bracket further has a through hole defined through the proximal end and connecting pivotally to the upper end of the stationary shaft.

3. The foldable guitar holder as claimed in claim 1, wherein the standing portion of the central shaft has a cushion enveloping the standing portion;

the standing end of the bending part of each assistant shaft has a cushion enveloping the standing end; and the standing part of each supporting shaft has a cushion enveloping the standing end.

4. The foldable guitar holder as claimed in claim 1, wherein the holding brackets have cushions enveloping the holding brackets.

5. The foldable guitar holder as claimed in claim 2, wherein the lower end of the stationary shaft has a screw, extends in the longitudinal hole in the central shaft and the limiting holes of the supporting shafts and is screwed with a nut.

6. The foldable guitar holder as claimed in claim 2, wherein the upper end of the stationary shaft has a screw, extends in the through holes in the holding brackets and is screwed with a nut.

7. The foldable guitar holder as claimed in claim 2, wherein a screw is mounted through the fastening hole of the central shaft and the pivoting holes of the assistant shafts, and a nut is screwed onto the screw;

the lower end of the stationary shaft has a screw mounted through the limiting holes of the supporting shafts and screwed with a nut; and a screw is mounted through the hole of each assistant shaft and the connecting hole of the supporting shaft of a corresponding bracket and is screwed with a nut.

8. The foldable guitar holder as claimed in claim 3, wherein the holding brackets have cushions enveloping the holding brackets.

9. The foldable guitar holder as claimed in claim 5, wherein the upper end of the stationary shaft has a screw, extends in the through holes in the holding brackets and is screwed with a nut.

* * * * *